US010272301B2

(12) United States Patent
Abe et al.

(10) Patent No.: US 10,272,301 B2
(45) Date of Patent: Apr. 30, 2019

(54) GOLF CLUB HEAD

(71) Applicant: DUNLOP SPORTS CO. LTD., Kobe-shi, Hyogo (JP)

(72) Inventors: Hiroshi Abe, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/176,377

(22) Filed: Jun. 8, 2016

(65) Prior Publication Data

US 2016/0361613 A1 Dec. 15, 2016

(30) Foreign Application Priority Data

Jun. 9, 2015 (JP) ..... 2015-117058

(51) Int. Cl.
*A63B 53/04* (2015.01)
*A63B 53/06* (2015.01)
(Continued)

(52) U.S. Cl.
CPC ..... *A63B 53/06* (2013.01); *A63B 53/0466* (2013.01); *A63B 60/02* (2015.10);
(Continued)

(58) Field of Classification Search
CPC ..... A63B 2053/0491
(Continued)

(56) References Cited

U.S. PATENT DOCUMENTS 4,340,229 A * 7/1982 Stuff, Jr. ..... A63B 69/3685 473/240
6,991,558 B2 * 1/2006 Beach ..... A63B 53/04 473/324

(Continued)

FOREIGN PATENT DOCUMENTS

JP 57-37114 U 2/1982
JP 11244433 A * 9/1999

(Continued)

OTHER PUBLICATIONS

Japanese Office Action, dated Jun. 19, 2018, for Japanese Application No. 2015-117058, with an English translation.

(Continued)

*Primary Examiner* — Alvin A Hunter
(74) *Attorney, Agent, or Firm* — Birch, Stewart, Kolasch & Birch, LLP

(57) ABSTRACT

The golf club head includes a decoration member to be attached in the recessed portion, and a fixing member for fixing the decoration member in the recessed portion. A fixing hole is formed in a bottom surface of the recessed portion, and the fixing member is provided with a tubular head portion and a shaft portion that is attached to the head portion, has a smaller diameter than the head portion and is to be fixed in the fixing hole. The decoration member has a through hole. The through hole includes a shaft portion insertion portion and a head portion in which the head portion is to be arranged, with a gap being formed at least in a portion that is externally exposed between the inner wall surface of the head portion arrangement portion and the outer peripheral surface of the head portion.

18 Claims, 6 Drawing Sheets

(51) Int. Cl.
*A63B 60/02* (2015.01)
*A63B 71/06* (2006.01)

(52) U.S. Cl.
CPC ..... *A63B 2053/0433* (2013.01); *A63B 2053/0491* (2013.01); *A63B 2071/0694* (2013.01)

(58) Field of Classification Search
USPC ..... 473/324–350
See application file for complete search history.

(56) References Cited

U.S. PATENT DOCUMENTS 7,396,295 B1 * 7/2008 Frame ..... A63B 53/0487 473/337
7,410,426 B2 * 8/2008 Willett ..... A63B 53/0466 473/334
7,462,110 B2 * 12/2008 Yamamoto ..... A63B 53/0466 473/334
8,092,316 B2 * 1/2012 Breier ..... A63B 53/0466 473/244
8,197,357 B1 * 6/2012 Rice ..... A63B 53/0466 473/334
8,414,422 B2 * 4/2013 Peralta ..... A63B 53/0466 473/334
8,905,858 B2 * 12/2014 Nivanh ..... A63B 53/04 473/324
9,433,836 B2 * 9/2016 Breier ..... A63B 53/0466
2002/0160854 A1 10/2002 Beach et al.
2007/0129160 A1 * 6/2007 Matsunaga ..... A63B 53/0466 473/332
2007/0129161 A1 * 6/2007 Matsunaga ..... A63B 53/0466 473/332
2007/0129164 A1 * 6/2007 Shimazaki ..... A63B 53/0466 473/338
2010/0331103 A1 * 12/2010 Takahashi ..... A63B 53/0466 473/338
2013/0165255 A1 * 6/2013 Bezilla ..... A63B 53/06 473/338
2014/0057739 A1 * 2/2014 Stites ..... A63B 53/0466 473/346

FOREIGN PATENT DOCUMENTS

JP 2000-160700 A 6/2000
JP 2001224713 A * 8/2001
JP 2004351154 A * 12/2004
JP 2006-435 A 1/2006
JP 2007-146942 A 6/2007
JP 2007-151830 A 6/2007
JP 2007-312846 A 12/2007
JP 4370254 B2 11/2009
JP 2010-169253 A 8/2010
JP 2011-30836 A 2/2011
WO WO 2004/043549 A1 5/2004

OTHER PUBLICATIONS

Japanese Office Action dated Feb. 5, 2019, for counterpart Japanese Patent Application No. 2015-117058, with an English translation.

* cited by examiner

GOLF CLUB HEAD

CROSS REFERENCE TO RELATED APPLICATION

This application claims a priority to Japanese Patent Application No. 2015-117058 filed on Jun. 9, 2015, which is hereby incorporated by reference in its entirety.

FIELD OF INVENTION

The present invention relates to a golf club head.

BACKGROUND OF THE INVENTION

JP 4370254 proposes a golf club head in which a recessed portion is formed in a sole portion and a weight can be removably attached in the recessed portion. Specifically, a circular decoration member (mass element) is arranged in the recessed portion, and a bolt-like fixing member is inserted into a through hole of this decoration member and fixed in the recessed portion. [0004] However, with a golf club head such as the above, there is a problem in that a gap occurs between the outer peripheral surface of a head portion of the fixing member and the through hole of the decoration member when a positional shift occurs in the fixing member relative to the decoration member, adversely affecting appearance. The present invention was made in order to resolve this problem, and an object thereof is to provide a golf club head that is able to prevent degradation in appearance qualities, even in the case where the fixing member is arranged at a shifted position relative to the decoration member.

SUMMARY of INVENTION

A golf club head according to the present invention includes a crown portion, a face portion, a sole portion having at least one recessed portion, a decoration member to be attached in the recessed portion, and a fixing member for fixing the decoration member in the recessed portion. A fixing hole is formed in a bottom surface of the recessed portion, the fixing member includes a tubular head portion and a shaft portion that is attached to the head portion, has a smaller diameter than the head portion and is to be fixed in the fixing hole, the decoration member has a through hole in which the fixing member is to be attached such that the head portion of the fixing member is externally exposed, and the through hole includes a shaft portion insertion portion in which the shaft portion is to be inserted and a head portion arrangement portion that has a larger diameter than the shaft portion insertion portion and in which the head portion is to be arranged, with a gap being formed at least in a portion that is externally exposed between an inner wall surface of the head portion arrangement portion and an outer peripheral surface of the head portion.

In the above golf club head, the inner wall surface of the head portion arrangement portion can be formed by a contacting portion that is to contact the outer peripheral surface of the head portion and a gap portion that is side by side with the contacting portion in an axial direction and has a larger diameter than the outer peripheral surface of the head portion.

In each of the above golf club heads, the outer peripheral surface of the head portion can be formed with a taper whose diameter decreases toward the shaft portion side, and an inner wall surface of the contacting portion of the through hole can be formed with a taper whose diameter decreases toward the shaft portion insertion portion side, so as to correspond to the outer peripheral surface of the head portion.

In each of the above golf club heads, the decoration member can be fixed in the recessed portion by adhesive.

In each of the above golf club heads, an externally facing surface of the decoration member and an externally facing surface of the head portion can be constituted so as to be arranged on a same plane.

In each of the above golf club heads, at least one of the fixing member and the decoration member can be an adjustment weight to be removably attached in the recessed portion.

The golf club head according to an one aspect of embodiment enables degradation in appearance qualities to be prevented, even in the case where the fixing member is arranged at a shifted position relative to the decoration member.

DETAILED DESCRIPTION OF THE PREFERRED EMBODIMENTS

Figure 1:
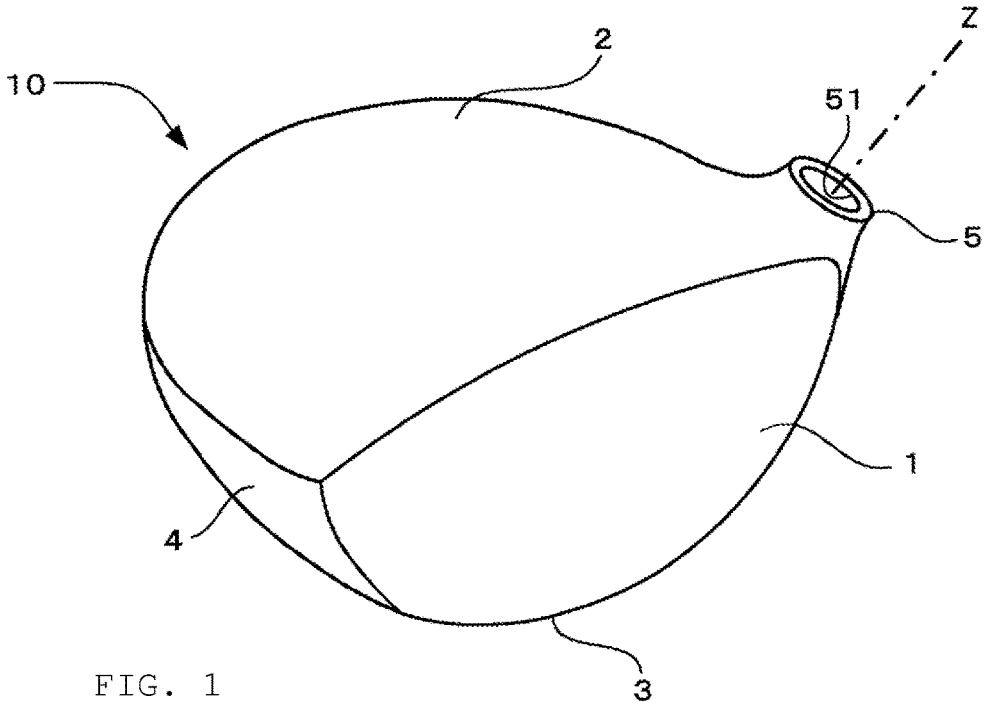
FIG. 1 is a perspective view of a reference state in one embodiment of a golf club head according to the present invention.
Figure 2:
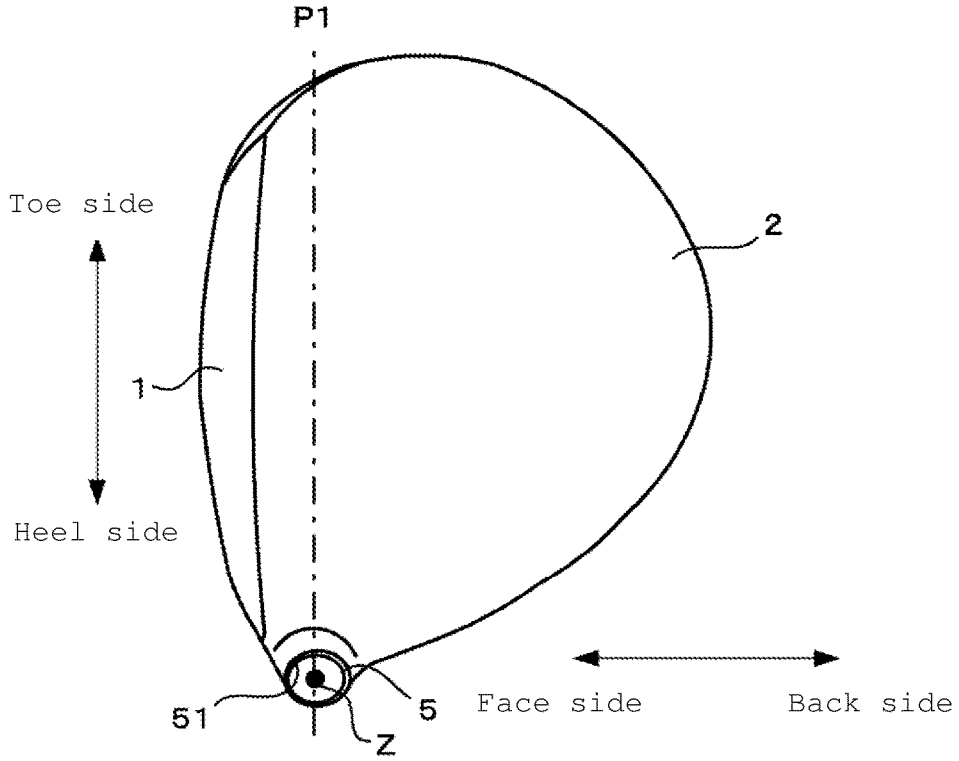
FIG. 2 is a plan view of FIG. 1.
Figure 3:
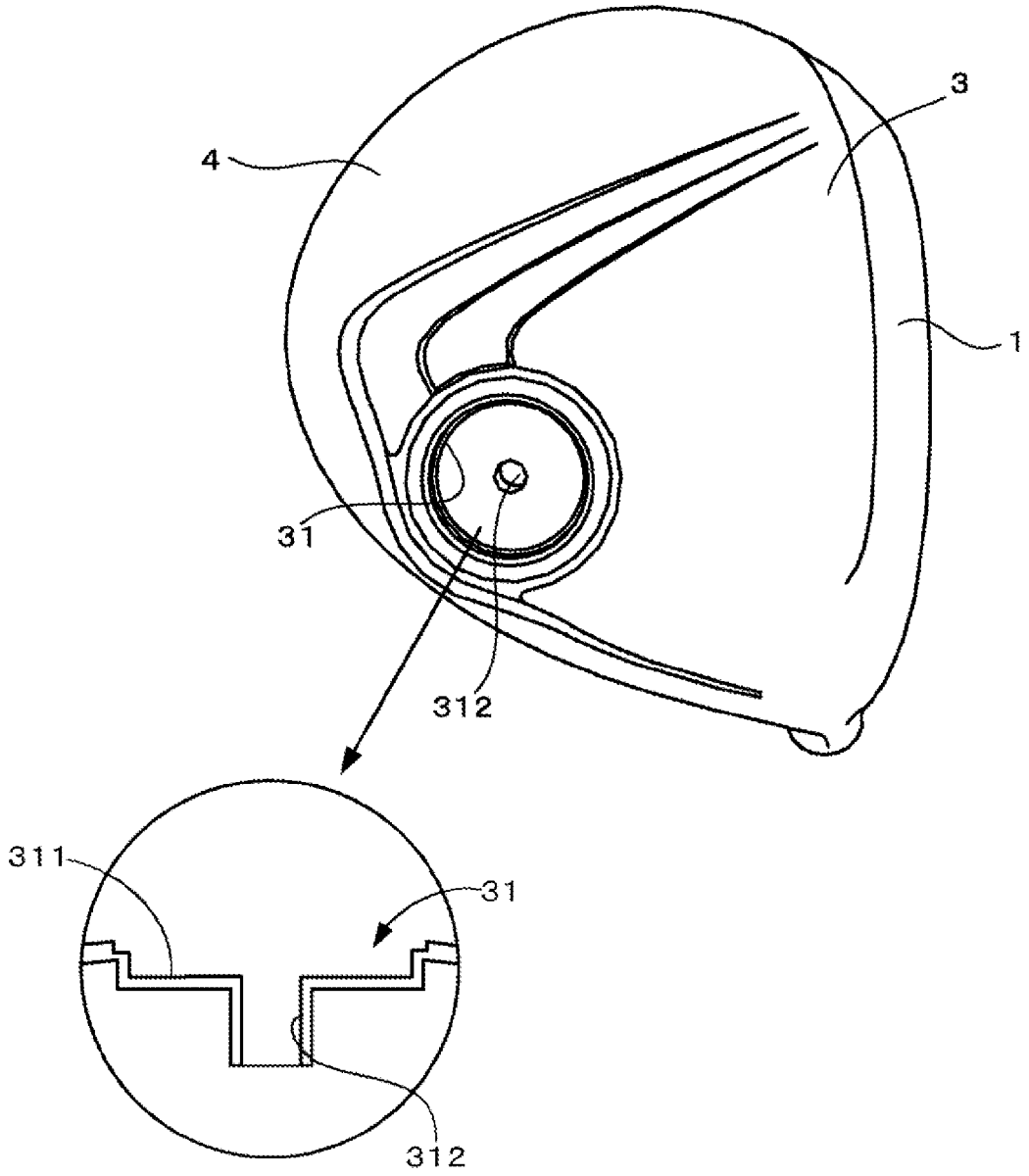
FIG. 3 is a bottom view of FIG. 1.

An embodiment of a golf club head according to the present invention will be described below with reference to the drawings. FIG. 1 is a perspective view of the golf club head according to the present embodiment, FIG. 2 is a plan view of FIG. 1, and FIG. 3 is a bottom view of FIG. 1. Hereinafter, an overview of the golf club head will be described first, and then a decoration member and a fixing member provided to the golf club head will be described.

1. Overview of Golf Club Head

As shown in FIG. 1, this golf club head (hereinafter, may be referred to as simply the "head") 10 has a hollow structure with an internal space, and wall surfaces thereof are formed by a face portion 1, a crown portion 2, a sole portion 3, a side portion 4, and a hosel portion 5.

The face portion 1 has a face surface, which is the surface that hits the ball, and the crown portion 2 is adjacent to the face portion 1 and constitutes the upper surface of the head. The sole portion 3 constitutes the bottom surface of the head, and is adjacent to the face portion 1 and the side portion 4. Also, the side portion 4 is the region between the crown portion 2 and the sole portion 3, and extends from the toe side of the face portion 1 to the heel side of the face portion 1 across the back side of the head. Furthermore, the hosel portion 5 is the region provided adjacent to the heel side of the crown portion 2, and has an insertion hole 51 for insertion of the shaft (not shown) of the golf club. A central axis Z of the insertion hole 51 coincides with the axis of the shaft.

The following describes the aforementioned reference state. First, as shown in FIGS. 1 and 2, a state in which the central axis Z is in a plane P1 that is perpendicular to the ground (horizontal surface) and the head 10 is placed on the ground at a predetermined lie angle and real loft angle is prescribed as the reference state. The plane P1 will be referred to as a reference perpendicular plane. Also, as shown in FIG. 2, the direction of the line of intersection of the reference perpendicular plane P1 and the ground will be referred to as the toe-heel direction, and the direction that is perpendicular to the toe-heel direction and parallel to the ground will be referred to as the face-back direction.

As shown in FIG. 3, a circular recessed portion 31 is formed in the sole portion 3, and a fixing hole 312 in which a female thread is formed is provided in a bottom surface 311 of this recessed portion 31. As described below, a decoration member 6 and a fixing member 7 for fixing this decoration member 6 in the recessed portion 31 are arranged in the recessed portion 31.

Also, in the present embodiment, the boundary between the sole portion 3 and the face portion 1 and between the sole portion 3 and the side portion 4 can be defined as follows. Specifically, if a ridge line is formed between the sole portion 3 and the face portion 1 and between the sole portion 3 and the side portion 4, that ridge line serves as the boundary. Also, although the golf club head according to the present embodiment has the side portion 4, in the case where, for example, the side portion 4 is not provided, the side portion 4 cannot be clearly distinguished and is included in the sole portion 3, or the sole portion 3 is directly connected to the crown portion 2, the ridge line between the sole portion 3 and the crown portion 2 serves as the boundary between both portions. Also, if a clear ridge line is not formed, the boundary is the outline that is seen when the head is placed in the reference state and viewed from directly above the center of gravity of the head 10. Note that, in consideration also of the case where the side portion cannot be clearly distinguished as described above, the "sole portion" according to the present invention is deemed to include the side portion.

Note that although an upper limit of the volume of the head 10 is not particularly defined, in terms of practical use, it is, for example, desirably 500 $cm^3$ or less, and desirably 470 $cm^3$ or less when complying with R&A or USGA rules and regulations.

Also, the head 10 can be formed from, for example, a titanium alloy (e.g., Ti-6Al-4V) having a specific gravity of approximately 4.4 to 4.5. Besides a titanium alloy, the head 10 can be formed from one or a plurality of materials selected from among stainless steel, maraging steel, an aluminum alloy, a magnesium alloy, an amorphous alloy, and the like.

Note that the head 10 according the present embodiment is configured by assembling at least a head body that has the sole portion 3 and another portion. For example, the head can be configured by constituting only the face portion 1 as a separate member and attaching the face portion 1 to the head body, or alternatively, the head can be configured by forming a head body with an opening provided in the crown portion 2 or the side portion 4 and blocking the opening with a separate member.

2. Fixing Member

Figure 4A:
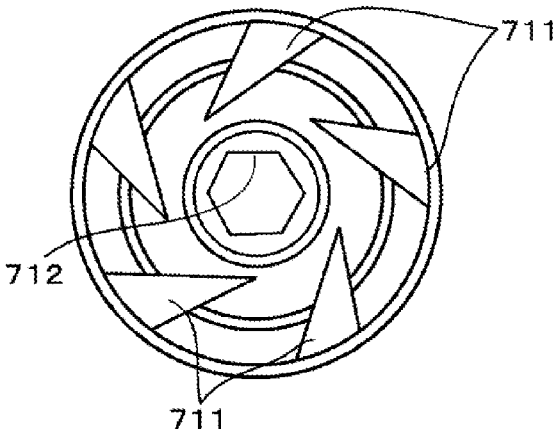
FIG. 4A is a plan view and FIG. 4B is a cross-sectional view of a fixing member.
Figure 4B:
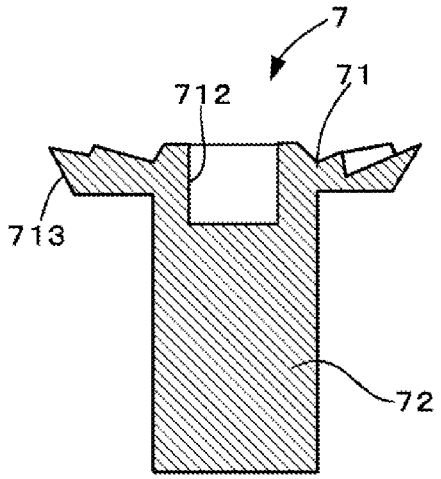

Next, the fixing member 7 will be described with reference to FIGS. 4A and 4B. FIG. 4A is a plan view and FIG. 4B is a cross-sectional view of the fixing member. For ease of description, the following description is based on the up-down direction in the drawings, but this direction does not necessarily limit the present invention. This point also applies to the following description of the decoration member 6 and attachment thereof.

As shown in FIGS. 4A and 4B, the fixing member 7 includes a disk-shaped head portion 71 and a shaft portion 72 that extends from the lower surface of the head portion 71. Also, the upper surface (externally facing surface or exposure surface) of the head portion 71 has been decorated. Specifically, on the upper surface of the head portion 71, a plurality of triangular recessed portions 711 that extend inward in the diameter direction from an outer peripheral edge thereof are formed at equal intervals. Also, at the center of the upper surface of the head portion 71, a tool hole 712 for inserting a tool such as a hex wrench or the like is formed. Furthermore, an outer peripheral surface 713 of the head portion 71 is formed with a taper whose diameter decreases downward. On the other hand, the shaft portion 72 is formed to have a columnar shape, and a male thread is formed on the outer peripheral surface thereof. This shaft portion 72 is configured to screw into the female thread of the fixing hole 312 of the recessed portion 31 formed in the aforementioned sole portion 3.

The material forming the fixing member 7 is not particularly limited, and a metal such as aluminum or stainless steel, a resin material or the like can be used, for example. Also, this fixing member 7 can be used as a weight for adjustment. Specifically, a plurality of types of differently weighted fixing members 7 with substantially the same shape are prepared. The weight and the center of gravity of the head can then be changed by using one of the plurality of types of fixing members 7.

3. Decoration Member

Next, the decoration member 6 will be described with reference to FIGS. 5A and 5B. FIG. 5A is a plan view and FIG. 5B is a cross-sectional view of the decoration member.

Figure 5B:
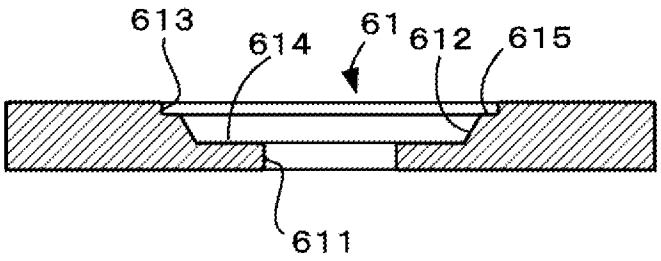
FIG. 5A is a plan view and FIG. 5B is a cross-sectional view of a decoration member.
Figure 5A:
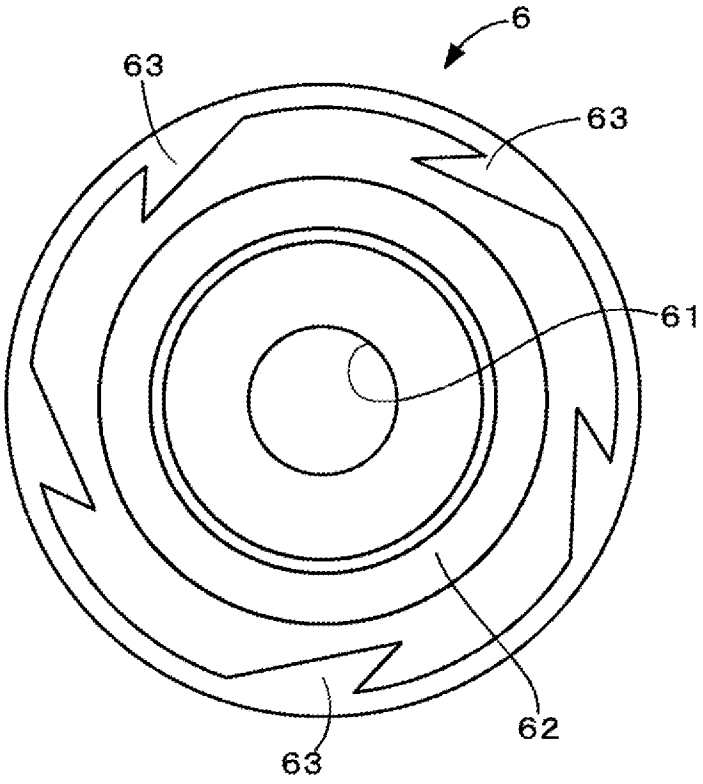

As shown in FIGS. 5A and 5B, the decoration member 6 is provided in order to decorate the sole portion 3. The decoration member 6 is formed to have a circular plate shape, and a through hole 61 is formed in the center thereof. The outer diameter of the decoration member 6 substantially matches the inner diameter of the recessed portion 31 of the sole portion 3, and the central through hole 61 is arranged in a position corresponding to the fixing hole 312 of the recessed portion 31. The upper surface of the decoration member 6 has been decorated, and decoration is possible with various methods. For example, decoration can be performed by coloring or forming a pattern with irregularities. In the example shown in FIGS. 5A and 5B, a ring 62 is formed around the through hole 61, and a plurality of triangular protruding portions 63 that extend inward in the diameter direction from an outer peripheral edge of the upper surface of the decoration member 6 form a pattern. A pattern is then formed on the upper surface of the decoration member 6 by shaving down the region excluding the ring 62 and the protruding portions 63 to form a recessed portion. Note that the protruding portions 63 of the decoration member 6 and the recessed portions 711 of the fixing member 7 are both formed to have a triangular shape, and achieve commonality in the pattern.

The through hole 61 is formed in order to attach the fixing member 7, and is constituted by three cylindrical regions. Specifically, the through hole 61 is constituted by a first portion 611 (shaft portion insertion portion) into which the shaft portion 72 of the fixing member 7 is to be inserted, second portion 612 (contacting portion) having a larger diameter than the first portion 611 and in which the head portion 71 is to be arranged, and a third portion 613 (gap portion) having a larger diameter than the second portion 612 and forming a gap on the peripheral edge of the head portion 71, and the first to third portions 611 to 613 are formed in the stated order so as to be continuous from the lower side to the upper side of the through hole 61. Note that a head portion arrangement portion of the present invention is constituted by the second portion 612 and the third portion 613 of the present embodiment.

The first portion 611 is formed with a slightly larger diameter than the shaft portion 72 of the fixing member 7. The second portion 612 has a larger diameter than the diameter of the first portion 611, and thus a first step portion 614 is formed between the second portion 612 and the first portion 611, and the lower surface of the head portion 71 of the fixing member 7 is configured to be placed on this first step portion 614. At this time, the depth of the first step portion 614 is prescribed such that the upper surface of the head portion 71 and the upper surface of the decoration member 6 are arranged generally on the same plane. Also, the inner wall surface of the second portion 612 is formed with a taper whose diameter decreases downward, and corresponds to the taper of the outer peripheral surface 713 of the head portion 71 of the fixing member 7.

The third portion 613 is formed with a slightly larger diameter than the diameter of the second portion 612, and when the head portion 71 of the fixing member 7 is mounted in the decoration member 6, the third portion 613 forms a gap on the peripheral edge of the head portion 71 of the fixing member 7. Specifically, a gap D is formed between the outer peripheral surface 713 of the head portion 71 and the inner wall surface of the third portion 613 (see FIG. 6). The width of the gap D is not particularly limited, and can be 0.1 to 2.0 mm, and more preferably 0.2 to 1.5 mm, for example. Also, a second step portion 615 is formed between the third portion 613 and the second portion 612, and this second step portion 615 is configured to be located at an intermediate portion of the mounted head portion 71 in the up-down direction.

The material forming the decoration member 6 is not particularly limited, and the decoration member 6 can also be formed with a metal such as stainless steel or aluminum, a resin material or the like, for example. Also, similarly to the fixing member 7, the decoration member 6 can be used as a weight for adjustment.

4. Attachment of Fixing Member and Decoration Member

Figure 6:
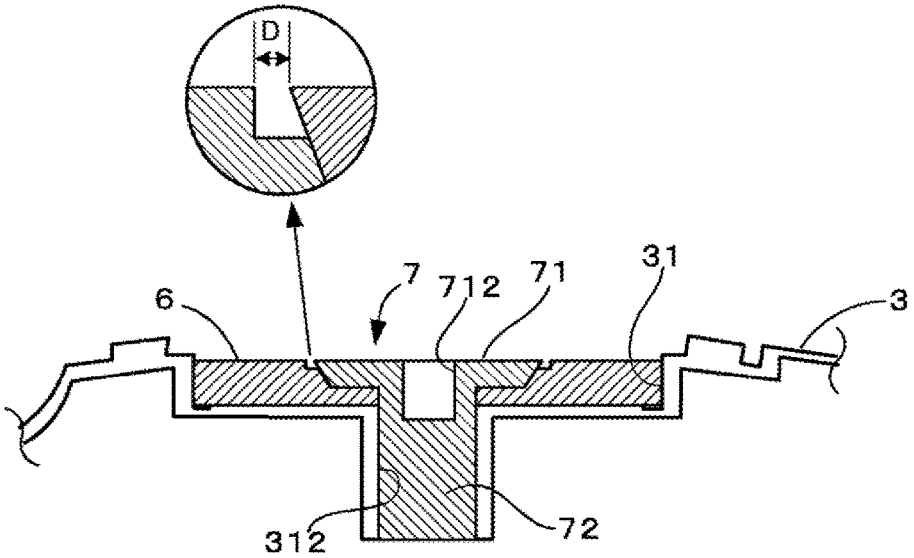
FIG. 6 is a cross-sectional view showing a state where the decoration member and the fixing member are attached to a sole portion.
Figure 7:
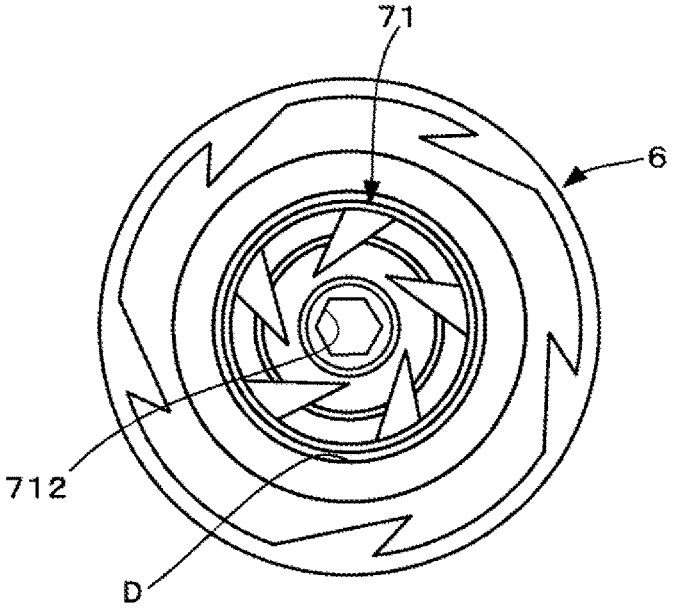
FIG. 7 is a plan view of FIG. 6.

Next, attachment of the fixing member and the decoration member will be described with reference to FIGS. 6 and 7. FIG. 6 is a cross-sectional view showing a state where the decoration member and the fixing member are attached to the sole portion, and FIG. 7 is a plan view of FIG. 6.

First, after an adhesive is applied to the lower surface of the decoration member 6, the decoration member 6 is arranged in the recessed portion 31 of the sole portion 3. Then, the fixing member 7 is arranged in the through hole 61 of the decoration member 6, and a hex wrench is inserted into the tool hole 712 of the upper surface of the fixing member 7 and rotated. The male thread of the shaft portion 72 of the fixing member 7 is thereby screwed into the female thread of the recessed portion 31. Then, when the fixing member 7 has been completely screwed in, the upper surface of the head portion 71 and the upper surface of the decoration member 6 are substantially level with each other. Attachment of the fixing member 7 and the decoration member 6 is thus completed, as shown in FIGS. 6 and 7.

5. Features

According to the present embodiment, as described above, since the third portion 613 having a larger diameter than the head portion 71 of the fixing member 7 is formed in the through hole 61 of the decoration member 6, the gap D is formed on the outer periphery of the head portion 71, when the fixing member 7 is mounted in the decoration member 6. Thus, there are advantages such as the following. For example, in the case where such a gap is not formed, the head portion 71 will be arranged in the through hole 61 without a gap. At this time, if a positional shift occurs in the head portion 71, a gap will occur in a portion between the through hole 61 and the head portion 71, possibly adversely affecting appearance. In contrast, when the gap D is formed in advance on the outer periphery of the head portion 71, such as in the present embodiment, even if the head portion 71 is attached at a slightly shifted position relative to the third portion 613, only the width of the preformed gap D changes, and thus the positional shift is not noticeable.

Also, since the outer peripheral surface 713 of the head portion 71 of the fixing member 7 and the inner wall surface of the second portion 612 of the decoration member 6 are formed with a taper, the head portion 71 can be fitted into the second portion 612, even in the case where a positional shift in the head portion 71 occurs due to dimension error, for example. Furthermore, the outer peripheral surface 713 of the head portion 71 presses the inner wall surface of the second portion 612 down as the fixing member 7 is screwed in, thus enabling the decoration member 6 to be firmly pressed against the bottom surface 311 of the recessed portion 31.

Furthermore, the decoration member 6 is fixed in the recessed portion 31 by adhesive, thus enabling the suppression of abnormal noise from the decoration member 6 caused by vibration. Also, the fixing member 7 is able to immediately fix the decoration member 6 in the recessed portion 31 by screw fastening, thus enabling the decoration member 6 to be fixed in the recessed portion 31, without waiting for the adhesive for fixing the decoration member 6 to dry.

6. Variations

Although an embodiment of the present invention has been described above, the present invention is not limited to the foregoing embodiment, and various modifications can be made without departing from the gist of the invention. The following are examples of modifications that can be made.

6.1

In the above embodiment, the decoration member 6 is formed to be circular, but is not particularly limited in shape, and can also be formed to have a polygonal shape, for example. Also, apart from being plate-shaped, the decoration member 6 may be formed to be block-shaped.

6.2

In the above embodiment, the inner wall surface of the second portion 612 of the through hole 61 of the decoration member 6 is formed with a taper, but can be formed to extend parallel to an axial direction of the through hole 61, without tapering. In this case, the outer peripheral surface 713 of the head portion 71 of the fixing member 7 can also be formed to extend parallel to the direction in which the shaft portion 72 extends, without tapering.

6.3

Figure 8:
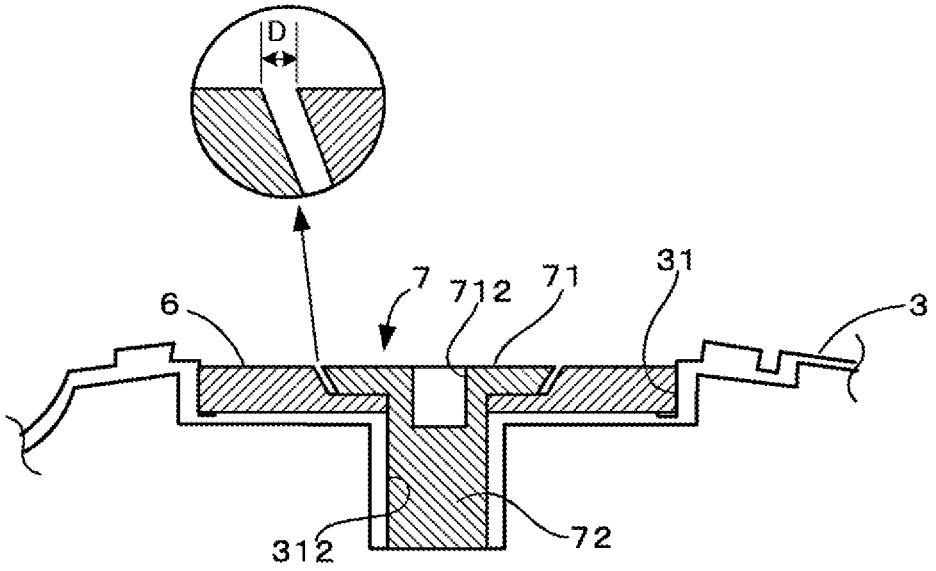
FIG. 8 is a cross-sectional view showing another example of the decoration member and the fixing member.

In the above embodiment, the region where the head portion 71 is arranged in the through hole 61 of the decoration member 6 is constituted by the second portion 612 and the third portion 613, but the gap D can, for example, also be formed with the entire outer peripheral surface of the head portion 71, as shown in FIG. 8, without forming a region that contacts the outer peripheral surface 713 of the head portion 71.

6.4

In the above embodiment, the upper surface of the head portion 71 of the fixing member 7 and the upper surface of the decoration member 6 are formed so as to be generally on the same plane, but the head portion 71 can also be formed to protrude or be recessed relative to the decoration member 6.

6.5

The fixing member 7 is fixed in the recessed portion 31 of the sole portion by screw fastening, but can, apart from screw fastening, also be fixed with adhesive or by snap-type fitting, for example.

6.6

In the above embodiment, one recessed portion 31 is provided, but a plurality of recessed portions 31 may be provided. A plurality of decoration members 6 and fixing members 7 can also be correspondingly provided.

6.7

In the aforementioned embodiment, a wood-type golf club was described, but the golf club according to the present invention is not limited to this. For example, the golf club may have a hollow head, such as so-called utility clubs and hybrid clubs.

REFERENCE SIGNS LIST

1 Face portion
2 Crown portion
3 Sole portion
31 Recessed portion
311 Bottom surface
312 Fixing hole
6 Decoration member
61 Through hole
611 First portion (shaft portion insertion portion)
612 Second portion (head portion arrangement portion, contacting portion)
613 Third portion (head portion arrangement portion, gap portion)
7 Fixing member
71 Head portion
713 Outer peripheral surface
72 Shaft portion
D Gap

The invention claimed is:

1. A golf club head comprising:
a crown portion;
a face portion;
a sole portion having at least one recessed portion;
a decoration member to be attached in the recessed portion; and
a fixing member for fixing the decoration member in the recessed portion,
wherein
a fixing hole is formed in a bottom surface of the recessed portion,
the fixing member includes a tubular head portion and a shaft portion that is attached to the head portion, has a smaller diameter than the head portion, and is to be fixed in the fixing hole,
the decoration member has a through hole in which the fixing member is to be attached such that the head portion of the fixing member is externally exposed,
the through hole includes a shaft portion insertion portion in which the shaft portion is to be inserted and a head portion arrangement portion that has a larger diameter than the shaft portion insertion portion and in which the head portion is to be arranged, with a gap being formed at least in a portion that is externally exposed between an inner wall surface of the head portion arrangement portion and an outer peripheral surface of the head portion,
the decoration member is fixed in the recessed portion by adhesive,
the inner wall surface of the head portion arrangement portion has an inner side wall surface and an inner bottom surface,
the inner side wall surface has a contacting portion that is to contact the outer peripheral surface of the head portion and a non-contacting portion that is not to contact the outer peripheral surface of the head portion,
a gap is formed between the non-contacting portion and the outer peripheral surface of the head portion, the gap being side by side with the contacting portion in an axial direction and having a larger diameter than the outer peripheral surface of the head portion,
the outer peripheral surface of the head portion is formed with a taper whose diameter decreases toward the shaft portion side, and
an inner wall surface of the contacting portion of the through hole is formed with a taper whose diameter decreases toward the shaft portion insertion portion side, so as to correspond to the outer peripheral surface of the head portion.

2. The golf club head according to claim 1, wherein an externally facing surface of the decoration member and an externally facing surface of the head portion are constituted so as to be arranged on a same plane.

3. The golf club head according to claim 1, wherein at least one of the fixing member and the decoration member is an adjustment weight to be attached in the recessed portion.

4. The golf club head according to claim 1, wherein the outer peripheral surface of the head portion is formed to extend parallel to a direction in which the shaft portion extends, and
the inner wall surface of the head portion arrangement portion is formed to extend parallel to a direction in which the shaft portion extends so as to correspond to the outer peripheral surface of the head portion.

5. The golf club head according to claim 4, wherein the gap is formed between an entire outer peripheral surface of the head portion and the inner wall surface of the head portion arrangement portion.

6. The golf club head according to claim 1, wherein, in a plane view of the sole portion, the recessed portion is formed to have circular shape.

7. The golf club head according to claim 6, wherein, in a plane view of the sole portion, the decoration member is formed to have circular shape along the recessed portion.

8. The golf club head according to claim 1, wherein, in a plane view of the sole portion, the decoration member is formed to have one of a polygonal shape, a plate-shape and a block-shape.

9. The golf club head according to claim 1, wherein an upper surface of the head portion of the fixing member and an upper surface of the decoration member are arranged on the same plane.

10. The golf club head according to claim 1, wherein the gap is formed between an entire outer peripheral surface of the head portion and the inner wall surface of the head portion arrangement portion.

11. The golf club head according to claim 1, wherein adhesive is not used in the gap.

12. A golf club head comprising:

a crown portion;

a face portion;

a sole portion having at least one recessed portion;

a decoration member to be attached in the recessed portion; and a fixing member for fixing the decoration member in the recessed portion, wherein a fixing hole is formed in a bottom surface of the recessed portion, the fixing member includes a tubular head portion and a shaft portion that is attached to the head portion, has a smaller diameter than the head portion, and is to be fixed in the fixing hole, the decoration member has a through hole in which the fixing member is to be attached such that the head portion of the fixing member is externally exposed, the through hole includes a shaft portion insertion portion in which the shaft portion is to be inserted and a head portion arrangement portion that has a larger diameter than the shaft portion insertion portion and in which the head portion is to be arranged, with a gap being formed at least in a portion that is externally exposed between an inner wall surface of the head portion arrangement portion and an outer peripheral surface of the head portion, and the head portion of the fixing member is formed to protrude or be recessed relative to an externally facing surface of the decoration member, the inner wall surface of the head portion arrangement portion has an inner side wall surface and an inner bottom surface, the inner side wall surface has a contacting portion that is to contact the outer peripheral surface of the head portion and a non-contacting portion that is not to contact the outer peripheral surface of the head portion, a gap is formed between the non-contacting portion and the outer peripheral surface of the head portion, the gap being side by side with the contacting portion in an axial direction and having a larger diameter than the outer peripheral surface of the head portion, the outer peripheral surface of the head portion is formed with a taper whose diameter decreases toward the shaft portion side, and an inner wall surface of the contacting portion of the through hole is formed with a taper whose diameter decreases toward the shaft portion insertion portion side, so as to correspond to the outer peripheral surface of the head portion.

13. The golf club head according to claim 12, wherein the gap is formed between an entire outer peripheral surface of the head portion and the inner wall surface of the head portion arrangement portion.

14. The golf club head according to claim 12, wherein at least one of the fixing member and the decoration member is an adjustment weight to be removably attached in the recessed portion.

15. The golf club head according to claim 12, wherein the outer peripheral surface of the head portion is formed to extend parallel to a direction in which the shaft portion extends, the inner wall surface of the head portion arrangement portion is formed to extend parallel to a direction in which the shaft portion extends so as to correspond to the outer peripheral surface of the head portion.

16. The golf club head according to claim 15, wherein the gap is formed between an entire outer peripheral surface of the head portion and the inner wall surface of the head portion arrangement portion.

17. The golf club head according to claim 12, wherein, in a plane view of the sole portion, the recessed portion is formed to have circular shape.

18. The golf club head according to claim 12, wherein adhesive is not used in the gap.

* * * * *